US006487756B1

(12) United States Patent
Vidal, Jr.

(10) Patent No.: US 6,487,756 B1
(45) Date of Patent: Dec. 3, 2002

(54) HAND TOOL LANYARD SYSTEM

(76) Inventor: Michael A. Vidal, Jr., 1831 N. Pass Ave., Burbank, CA (US) 91505

( * ) Notice: Subject to any disclaimer, the term of this patent is extended or adjusted under 35 U.S.C. 154(b) by 0 days.

(21) Appl. No.: 09/864,520

(22) Filed: May 23, 2001

(51) Int. Cl.[7] ..... A61J 17/00
(52) U.S. Cl. ..... 24/3.1; 24/3.11; 24/3.13; 242/379.2
(58) Field of Search ..... 24/3.1, 3.13, 3.6; 242/379, 279.2; 70/456 R

(56) References Cited

U.S. PATENT DOCUMENTS 3,100,608 A * 8/1963 Goldfarb
5,363,680 A * 11/1994 Wu ..... 70/456 R
5,864,925 A * 2/1999 McGee ..... 24/3.11
6,073,875 A * 6/2000 Paugh ..... 242/379.2
6,112,357 A * 9/2000 Halloran ..... 15/106
6,243,921 B1 * 6/2001 Chang ..... 24/3.13
6,290,158 B1 * 9/2001 Huang ..... 242/379

* cited by examiner

*Primary Examiner*—Robert J. Sandy
(74) *Attorney, Agent, or Firm*—Sheldon & Mak; Denton L. Anderson

(57) ABSTRACT

A hand tool and lanyard combination comprised of a hand tool to which a lanyard is removably attached. The lanyard is a length of flexible cable having an anchor and a free end. The anchor end has a housing with a spring mounted rotatable spool disposed within the housing so that the length of flexible cable is retractable by the rotation of the rotatable spool. The free end has a free end attachment mechanism for removably attaching the free end to the hand tool.

9 Claims, 10 Drawing Sheets

HAND TOOL LANYARD SYSTEM

BACKGROUND OF THE INVENTION

This invention addresses the problem of how a worker can securely retain his or her hand tools, especially when working at elevated locations.

SUMMARY

The invention is a combination comprising a hand tool and a detachable lanyard attached to the hand tool. The lanyard comprises a length of flexible cable having an anchor end and a free end. The anchor end has a housing with a spring-mounted rotatable spool disposed within the housing so that the length of flexible cable is retractable by the rotation of the rotatable spool. The free end having a free end attachment mechanism for removably attaching the free end to the hand tool.

DESCRIPTION OF THE DRAWINGS

These features, aspects and advantages of the present invention will become better understood with regard to the following description, appended claims and accompanying figures where:

DESCRIPTION OF THE INVENTION

Figure 1:
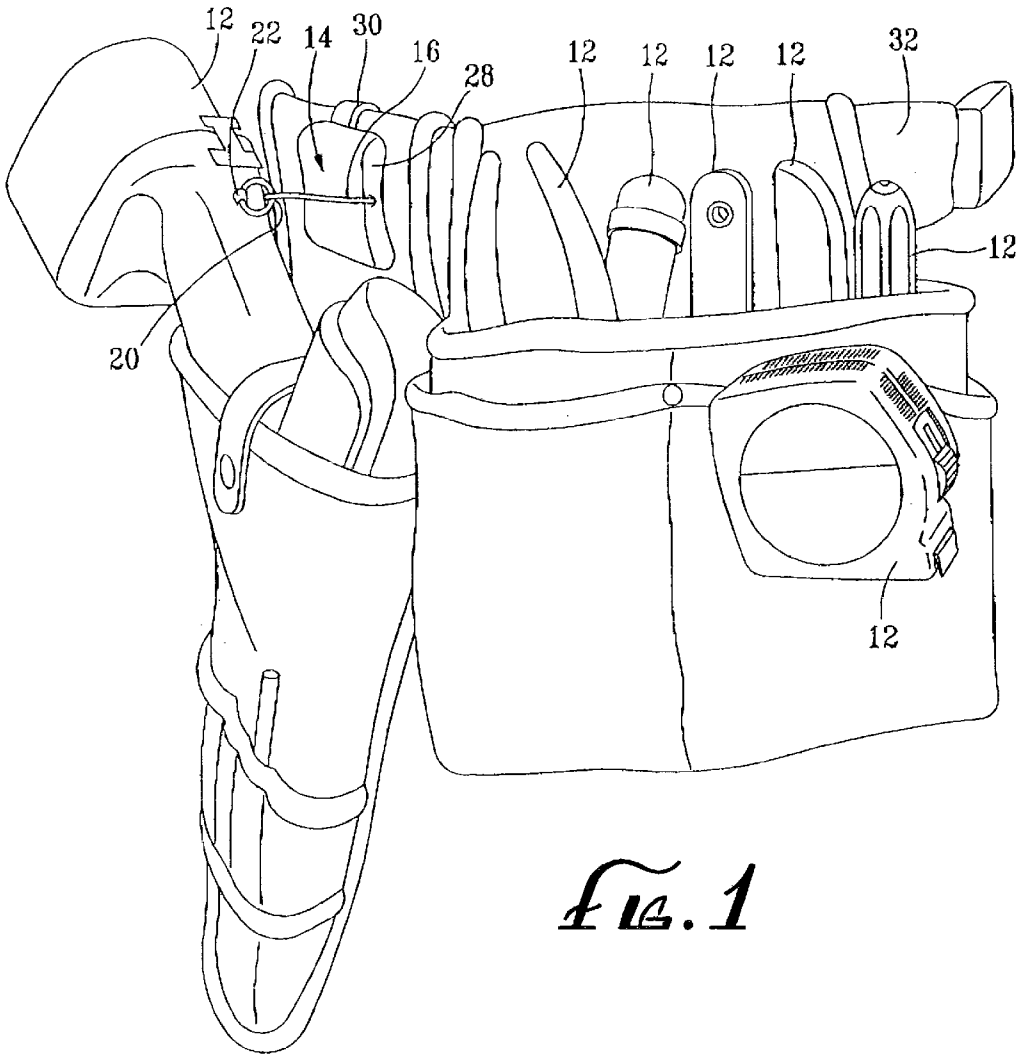
FIG. 1 is an isometric view of a tool belt and tool combination having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

In the invention, one or more of the worker's hand tools 12 are readily attachable and deattachable by a lanyard 14 which prevents the hand tool 12 from falling away from the worker.

The lanyard 14 comprises a short length of flexible cable 16 retained on a cable retainer spool 18. At the free end 20 of the cable 16 is a tool attachment connector 22 which allows the lanyard 14 to be readily attached to and deattached from a hand tool 12. The cable 16 is typically made from a thin metallic material. Other materials, such as nylon cord, chain, braided cable, woven elastic cord ("bungee cord"), plastic mono-filament line ("fishing line"), and even string can also be used. Typically, the cable 12 has a length of between about 2 feet and about 4 feet.

The cable 16 should be sufficiently strong so as to not break when a hand tool 12 used with the lanyard 14 is inadvertently dropped by the user. The cable 16 also should be sufficiently flexible to allow full use of the hand tool 12 when the hand tool 12 is attached to the lanyard 14.

The cable retainer spool 18 typically comprises a rotatable spool 24 disposed within a spool housing 26. Preferably, the rotatable spool 24 is spring mounted within the spool housing 26 so as to make the cable 16 retractable. Preferably, the spring mounted rotatable spool 24 only exerts sufficient force to draw the cable 16 back into the cable housing 26 when the tool 12 to which the lanyard 14 is attached is not in use.

The spool housing 26 can be conveniently housed within a pouch 28, such as a leather pouch, as illustrated in the drawings.

Figure 2:
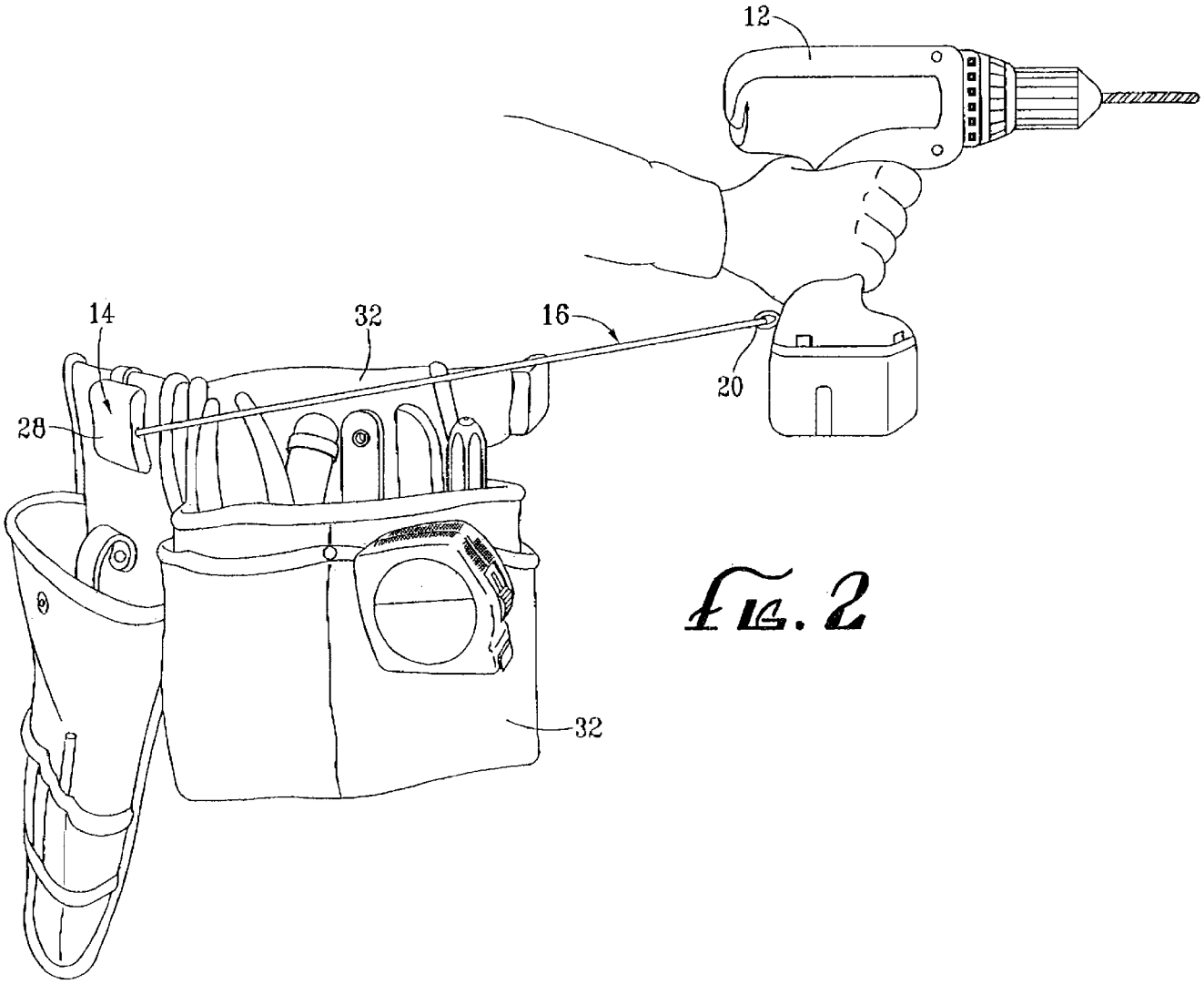
FIG. 2 is an isometric view of the combination illustrated in FIG. 1 showing the use of one of the tools in the invention.
Figures 3, 4, 5:
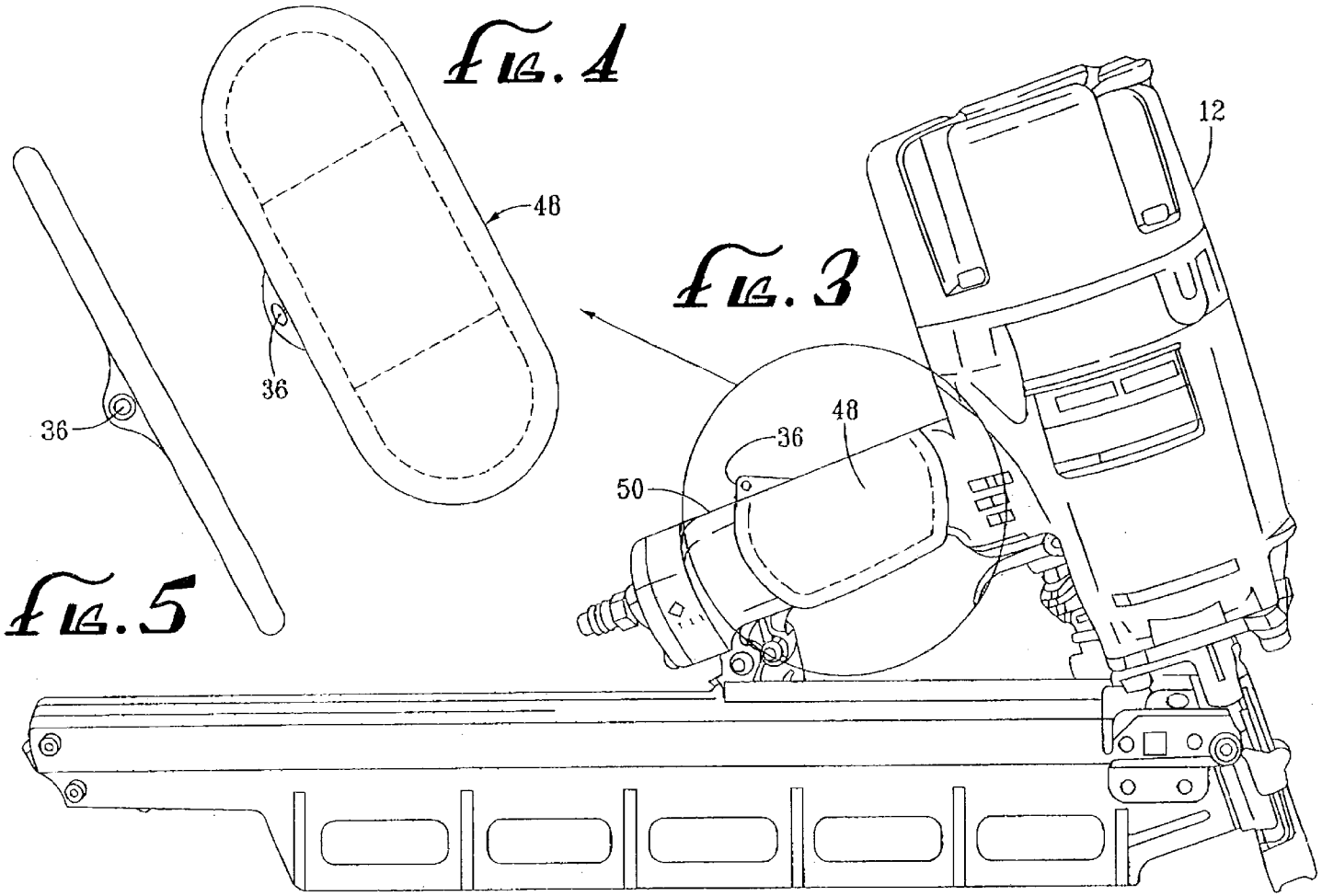
FIG. 3 is an isometric view of a hand tool illustrating the use of a unique gripping pad.
FIG. 4 is a plan view of the gripping pad illustrated in FIG. 3.
FIG. 5 is a side view of the gripping pad illustrated in FIGS. 3 and 4.
Figure 6:
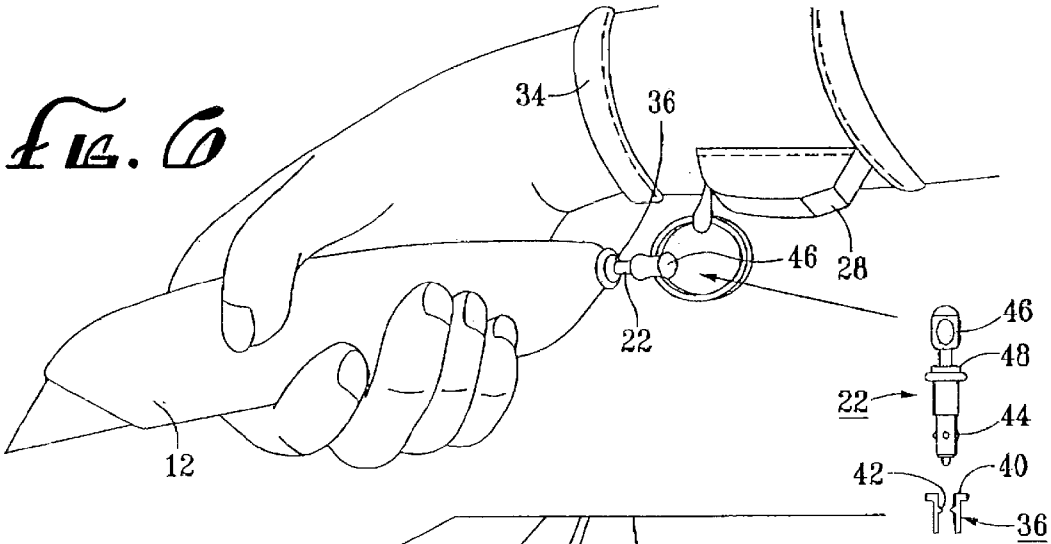
FIG. 6 is an isometric view of an additional embodiment of the invention.
Figure 8:
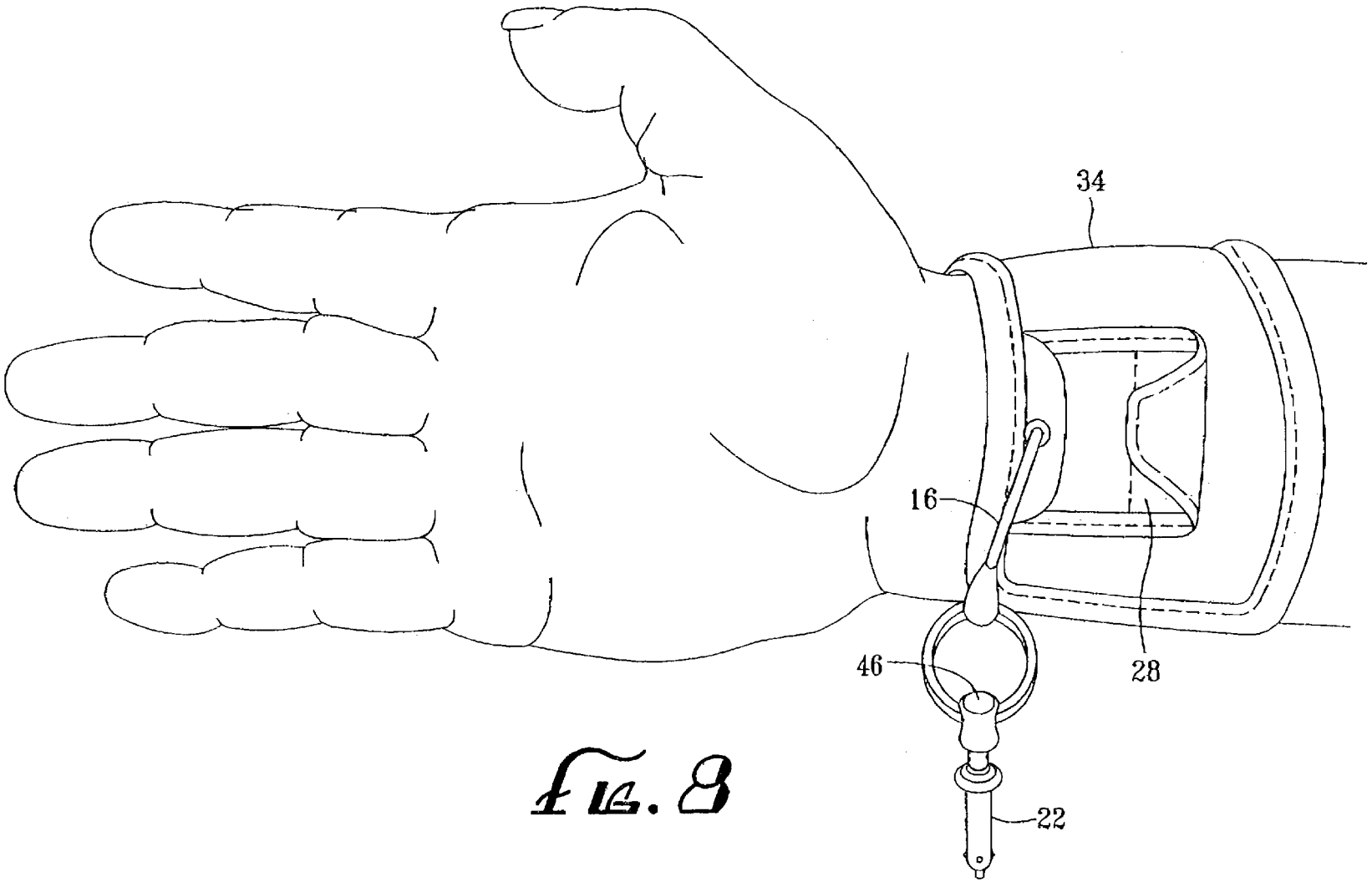
FIG. 8 is an isometric view of an additional embodiment of the invention wherein the lanyard is attached to the wrist of the user.
Figure 9:
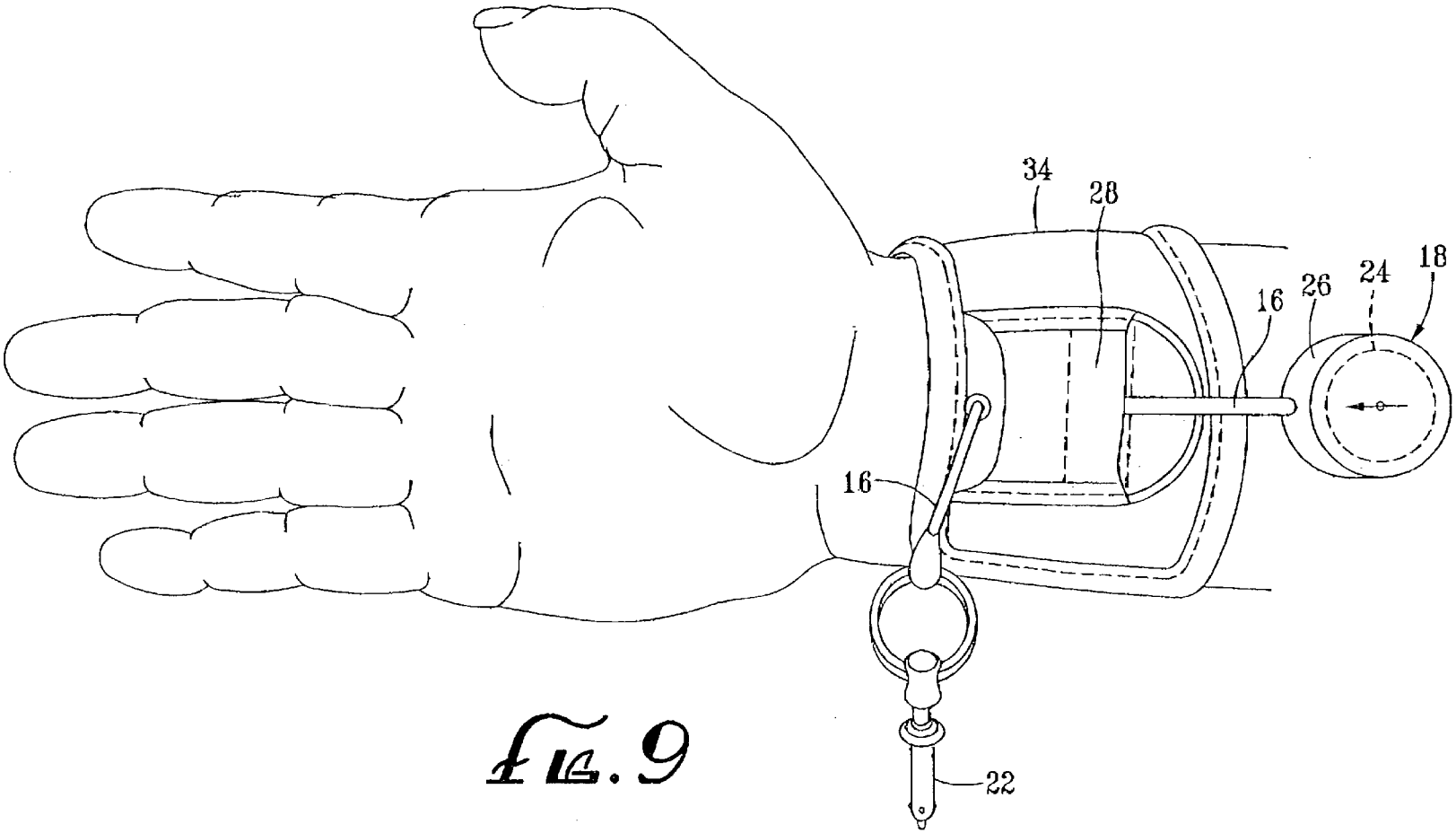
FIG. 9 is an isometric view of the embodiment illustrated in FIG. 8 showing the insertion of a cable retainer spool into a pouch attached to the wrist of the user.
Figure 10:
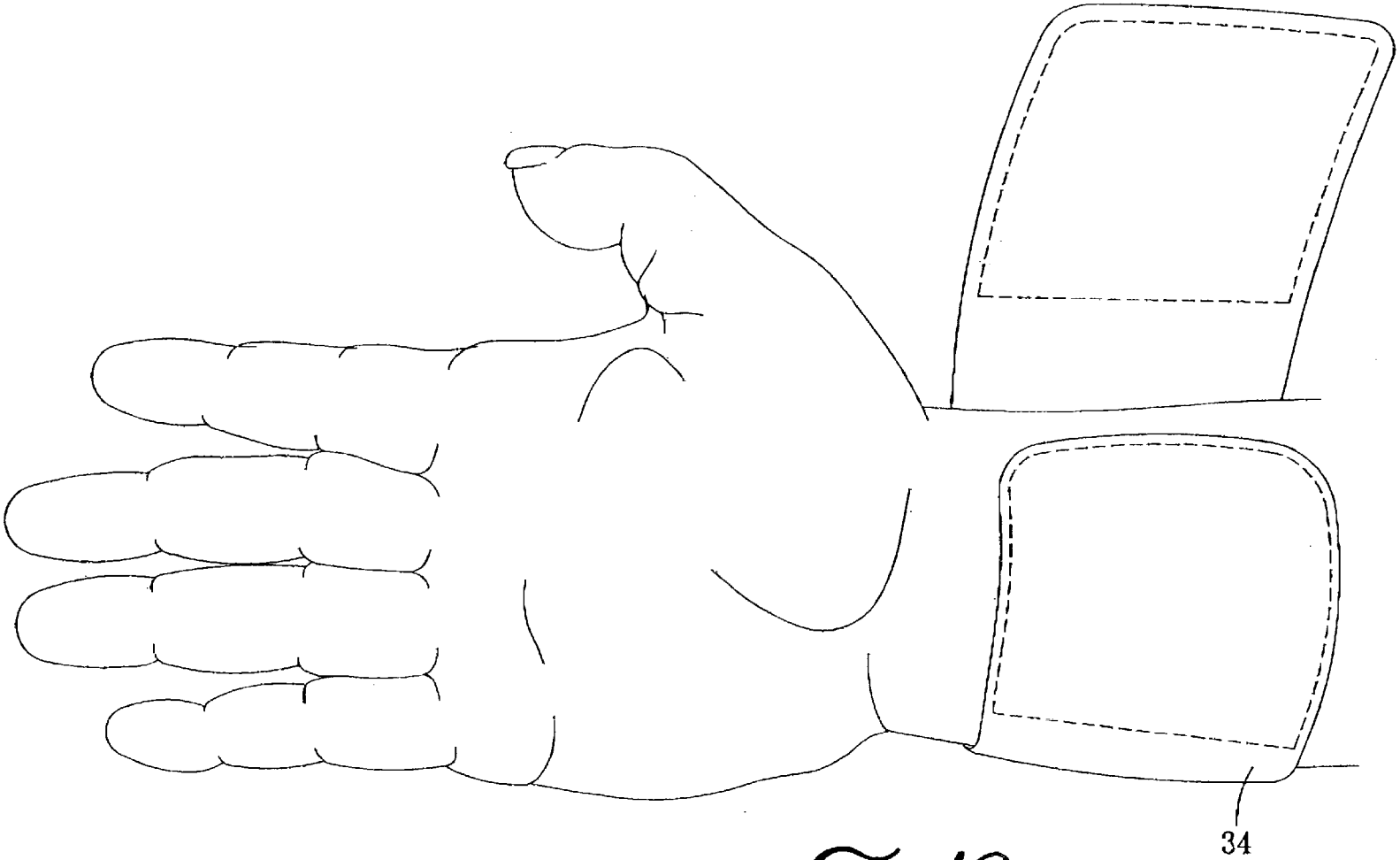
FIG. 10 illustrates the attachment of a wrist band used in the embodiment illustrated in FIGS. 8 and 9.
Figure 11:
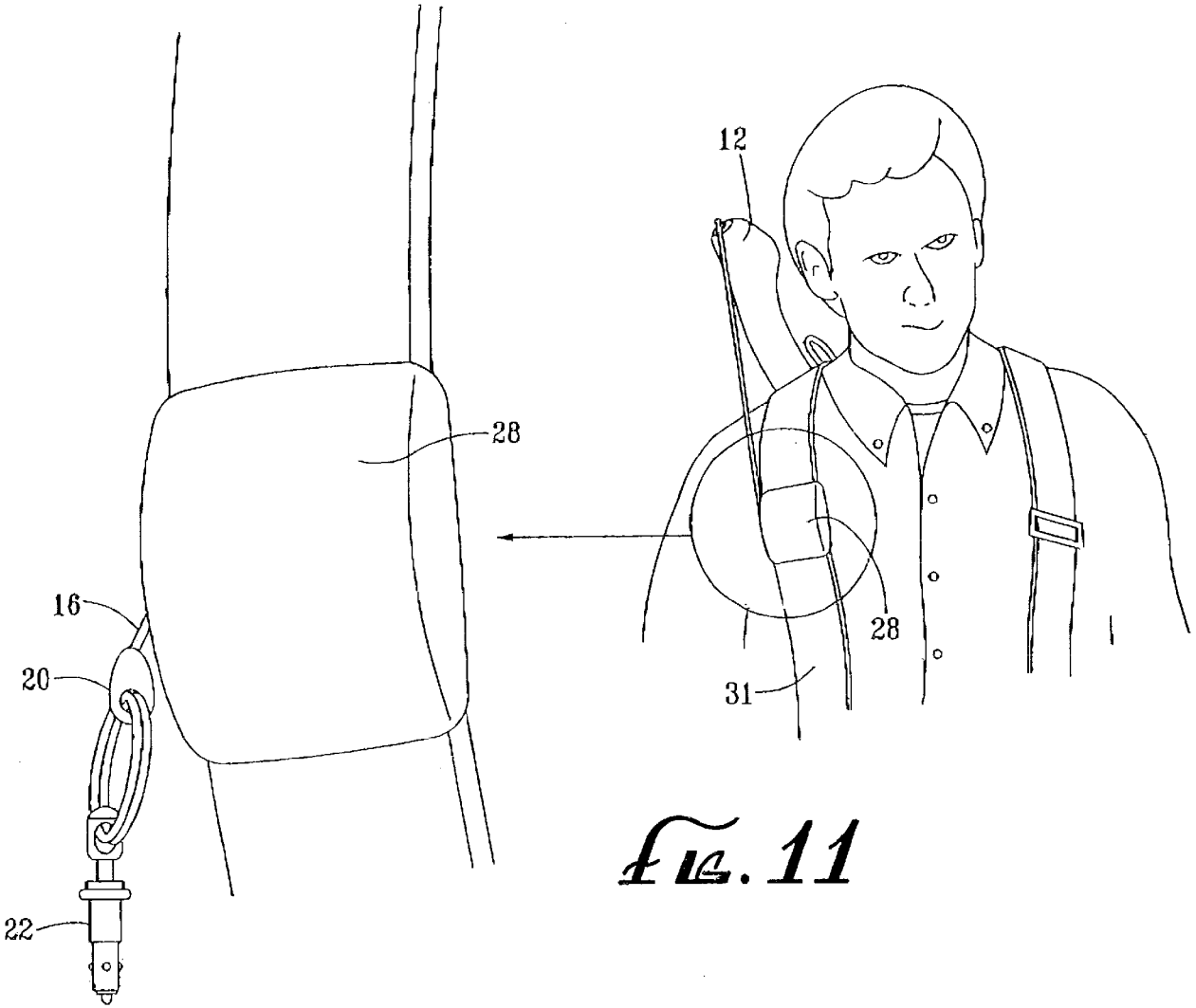
FIG. 11 is an isometric view illustrating the attachment of a lanyard having features of the invention to the shoulder strap of a user.
Figure 12:
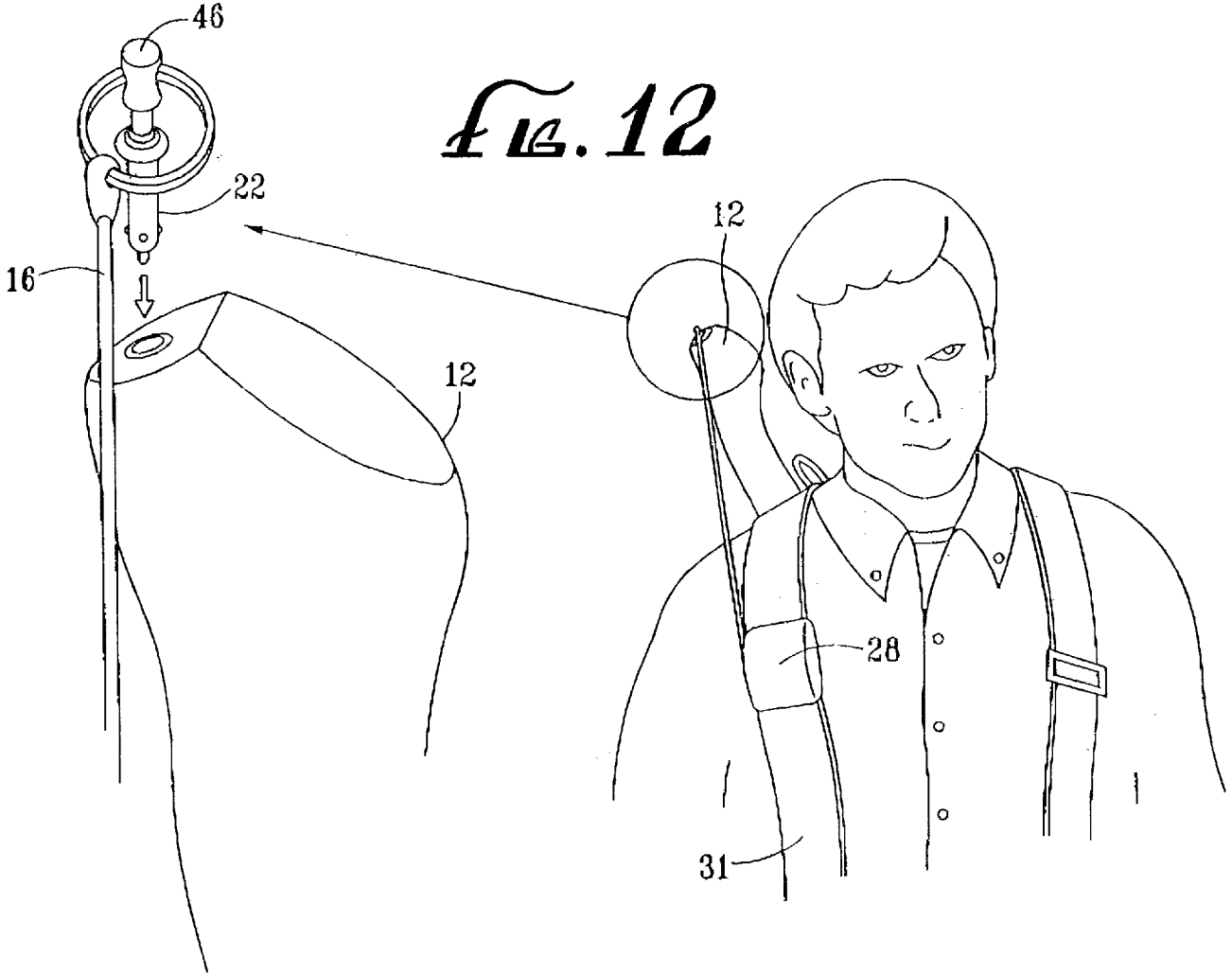
FIG. 12 is an isometric view illustrating the use of the invention with a tool secured to the back of the user.
Figure 13:
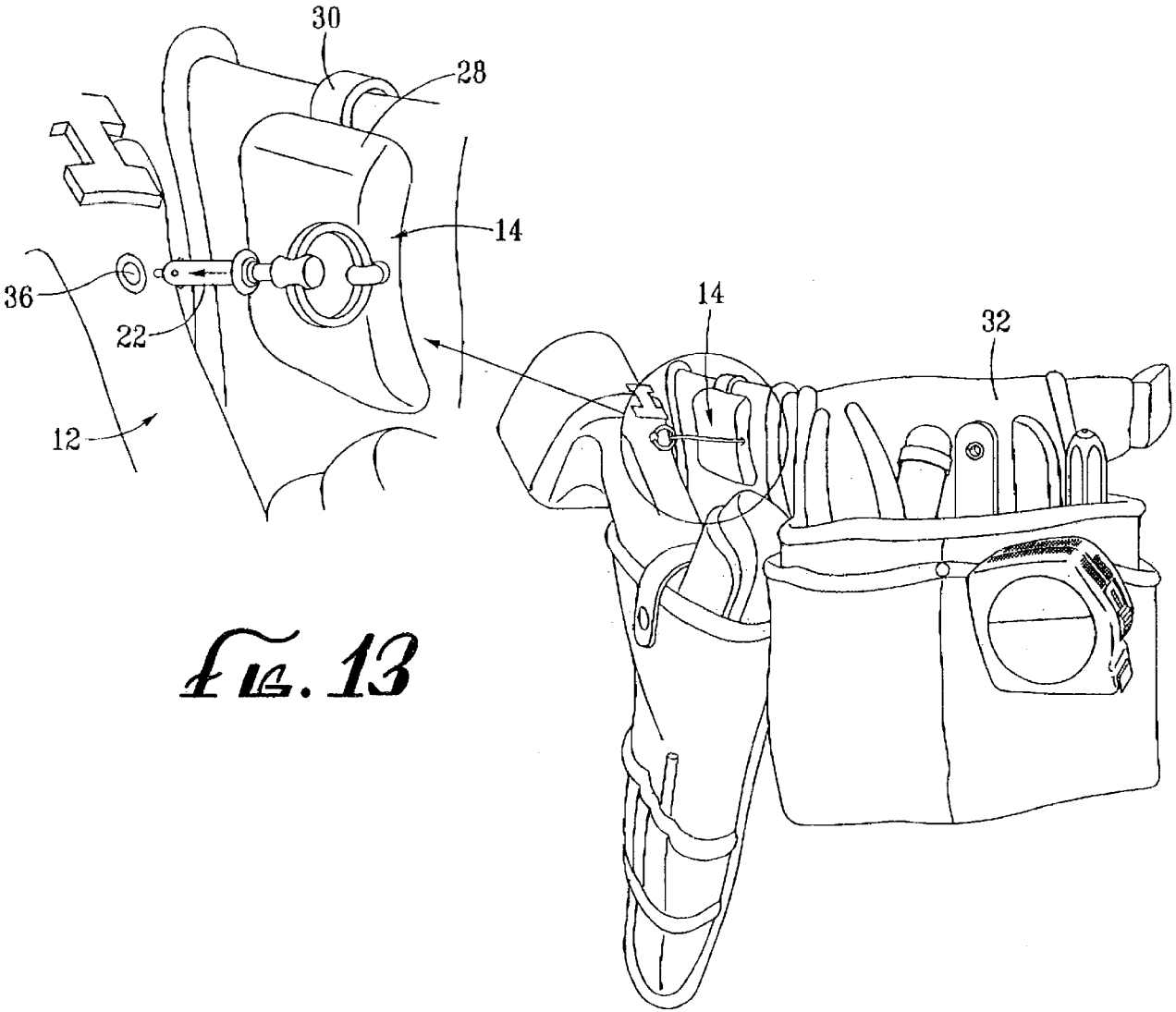
FIG. 13 illustrates the attachment of a lanyard having features of the invention to a hand tool.

The lanyard 14 further comprises a retainer spool attachment device 30, such as clips, clamps or other mechanical attachment means which facilitate the rapid attachment and 25 deattachment of the cable retainer spool 24 to the person of the user or to a solid object proximate to where the user is working. FIGS. 11 and 12 illustrate how the cable retainer spool 24 is attached to the shoulder strap 31 of the user. FIGS. 1–3 illustrate how the cable retainer spool 24 is attached to the worker's tool belt 32. FIGS. 6, 8 and 10 illustrate the attachment of the cable retainer spool 24 to the wrist of the user using a wrist band 34. The wrist band 34 is typically made from a nylon cloth or leather construction. The wrist band 34 has the additional advantage of acting as an elastic bandage, thereby supporting the wrist and reducing fatigue in the wrist. Typically, the wrist band 34 is attachable and deattachable to the user using hook and loop fasteners or snaps.

Figure 7:
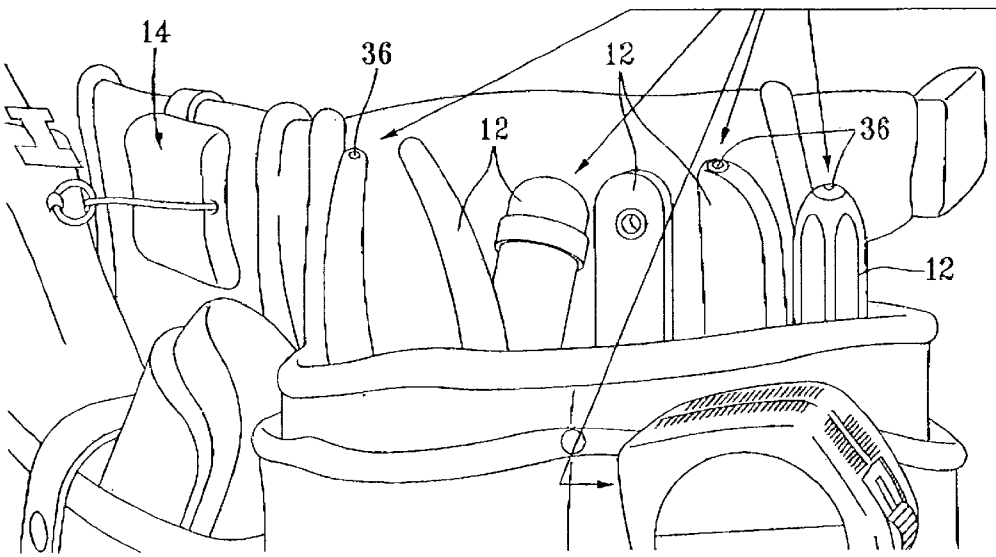
FIG. 7 is a diagrammatic view of an attachment pin combination having features of the invention.

The tool attachment connector 22 is preferably of the "snap-on" variety, wherein the tool attachment connector can be readily attached and de-attached from a corresponding lanyard receiving connector 36 located within a hand tool 12. In a preferred embodiment, the tool attachment connector 22 is a push-release, spring-loaded, ball bearing locking pin, as illustrated in FIG. 7. In this embodiment, the tool attachment connector 22 is a male-type connector adapted to be received and retained within a corresponding female receptor 40. This female connector 40 comprises an inwardly projecting flange 42 suitable for engaging and retaining retractable projection members 44, such as ball bearings disposed within the tool attachment connector 22. In a typical embodiment, the tool attachment connector 22 is readily disengaged from the lanyard receiving connector 36 in the hand tool 12 by depressing a spring-loaded button 46 on the back side 48 of the tool attachment connector 22.

Other attachment devices can also be used as the tool attachment connector 22, such as clips, screws, snaps, clamps, hook and loop fasteners and the like.

As illustrated in the drawings, lanyard receiving connectors 36 can be disposed within a wide variety of hand tools 12, including tape measures, screwdrivers, hammers, axes, pliers, screw guns and cutting tools.

In one embodiment of the invention, the lanyard receiving connector 36 is disposed within a removable handle gripping pad 48 as illustrated in FIGS. 3–5. In this embodiment, the handle gripping pad 48 can be easily attached and deattached from the handle 50 of a hand tool 12 by hook and loop fasteners or snaps.

The lanyard 14 can be used in a wide variety of activities where the dropping of tools 12 presents a significant problem, such as high construction, welding, electrical and telephone work. Also, the lanyard 14 is useful in scuba diving, sky diving, rock climbing, mineralogy, ice climbing, fire fighting and aerial rescue efforts.

In operation, a worker intending to use a particular hand tool 12 disposed within the worker's tool belt 32 first grips the tool attachment connector 22 and pulls a length of the cable 16 out from the cable retainer spool 18 sufficient to reach the hand tool 12 to be used. Next, the worker snaps the tool attachment connector 22 into the corresponding lanyard receiving connector 36 disposed within the tool 12. The worker then uses the hand tool 12 in the usual manner. The fact that the hand tool 12 is tethered to the lanyard 14 does not effect the use of the tool 12 because the retractive force of the spring within the cable retainer spool 18 is almost imperceptibly slight. If the worker should inadvertently drop the tool 12 during its use, the tool 12 only falls the distance of the cable 16. Since the cable 16 is typically only about 3 feet in length, the inadvertently dropping of the tool 12 causes no danger to the tool 12 itself or to other individuals working beneath the worker. When the worker is finished with the hand tool 12, the hand tool 12 is disposed back into the worker's tool belt 32 and the tool attachment connector 22 can be removed from the lanyard receiving connector 36. The lanyard 14 is then ready to be used with a different tool 12 to be selected by the worker from his or her tool belt 32.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A combination comprising a hand tool and a detachable lanyard attached to the hand tool, the lanyard comprising a length of flexible cable having an anchor end, a free end and a spring-mounted rotatable spool disposed within the housing so that the length of flexible cable is retractable by the rotation of the rotatable spool, the free end having a free end attachment mechanism for removably attaching the free end to the hand tool, the free end attachment mechanism being a quick release attachment device comprising a male connection pin, the hand tool being provided with at least one female receptor capable of accepting and firmly retaining the male connection pin.

2. The combination of claim 1 wherein the length of flexible cable is made from steel.

3. The combination of claim 1 wherein the lanyard comprises a retainer spool attachment device.

4. The combination of claim 1 wherein the hand tool is a hammer.

5. The combination of claim 1 wherein the hand tool comprises an electric motor.

6. The combination of claim 1 wherein the quick release attachment device comprises a push-release, spring-loaded, ball bearing locking pin.

7. A combination comprising a hand tool and a detachable lanyard attached to the hand tool, the lanyard comprising a length of flexible steel cable having an anchor end, a free end and a housing with a spring-mounted rotatable spool disposed within the housing so that the length of flexible cable is retractable by the rotation of the spring-mounted rotatable spool, the free end having a quick release attachment mechanism for removably attaching the free end to the hand tool, the quick release attachment device comprising a push-release, spring-loaded, ball bearing locking pin.

8. The combination of claim 7 wherein the hand tool comprises an electric motor.

9. The combination of claim 7 wherein the hand tool is a hammer.

* * * * *